US011957198B2

(12) United States Patent
Kim

(10) Patent No.: US 11,957,198 B2
(45) Date of Patent: Apr. 16, 2024

(54) CONVERTIBLE HAT

(71) Applicant: Min Sok Kim, Pyeongtaek-si (KR)

(72) Inventor: Min Sok Kim, Pyeongtaek-si (KR)

( * ) Notice: Subject to any disclaimer, the term of this patent is extended or adjusted under 35 U.S.C. 154(b) by 133 days.

(21) Appl. No.: 17/768,219

(22) PCT Filed: Nov. 5, 2020

(86) PCT No.: PCT/KR2020/015369

§ 371 (c)(1),
(2) Date: Apr. 12, 2022

(87) PCT Pub. No.: WO2021/096158

PCT Pub. Date: May 20, 2021

(65) Prior Publication Data

US 2023/0320447 A1 Oct. 12, 2023

(30) Foreign Application Priority Data

Nov. 14, 2019 (KR) ..... 10-2019-0145972

(51) Int. Cl.

| | |
|---|---|
| ***A42B 1/206*** | (2021.01) |
| ***A42B 1/0184*** | (2021.01) |
| ***A42B 1/0185*** | (2021.01) |
| ***A42B 1/0187*** | (2021.01) |
| ***A42B 1/201*** | (2021.01) |
| ***A42B 1/205*** | (2021.01) |
| ***A42B 1/22*** | (2006.01) |

(52) U.S. Cl.

CPC ..... *A42B 1/206* (2013.01); *A42B 1/0184* (2021.01); *A42B 1/0185* (2021.01); *A42B 1/0187* (2021.01); *A42B 1/201* (2013.01); *A42B 1/205* (2013.01); *A42B 1/22* (2013.01)

(58) Field of Classification Search

CPC ... A42B 1/0182; A42B 1/0185; A42B 1/0187; A42B 1/201; A42B 1/205; A42B 1/206

See application file for complete search history.

(56) References Cited

U.S. PATENT DOCUMENTS 2,051,594 A * 8/1936 Dubin ..... A42B 1/201 2/175.1

5,790,986 A 8/1998 Hall (Continued)

FOREIGN PATENT DOCUMENTS

JP 2001-146621 A 5/2001
KR 10-0799081 B1 2/2008

(Continued)

*Primary Examiner* — Katherine M Moran

(57) ABSTRACT

A convertible hat is disclosed. The convertible hat of the present invention comprises: a band (110) coupled to the head of a user; and a brim (120) provided horizontally in a certain area on the front surface of the band (110) to block sunlight. Furthermore, the convertible hat of the present invention preferably includes a pair of shape transformation crowns (130, 130*a*) that each have one end coupled to the band (110) and the other end spread out over the band (110), and are positioned in either a cap position in which the crowns cover the head of the user, or a sun cap position in which the crowns extend from the side surface of the brim (120) to increase the sun blocking area of the brim (120). Accordingly, a single convertible hat can be used by transforming into the two forms of a cap and a sun cap.

4 Claims, 10 Drawing Sheets

(56) References Cited

U.S. PATENT DOCUMENTS

| | | | | |
|---|---|---|---|---|
| 6,560,785 | B1 * | 5/2003 | Taguchi | A42B 1/206 2/171.1 |
| 7,962,971 | B1 * | 6/2011 | Spence | A42B 1/206 2/171.7 |
| 2007/0044203 | A1 * | 3/2007 | Hall | A42B 1/206 2/171 |
| 2012/0110718 | A1 * | 5/2012 | Kim | A42B 1/0182 2/209.12 |
| 2016/0309825 | A1 * | 10/2016 | McGufogg | A42B 1/22 |
| 2016/0374420 | A1 * | 12/2016 | Woo | A42B 1/0182 2/172 |
| 2022/0395044 | A1 * | 12/2022 | Hespeth | A42B 1/206 |

FOREIGN PATENT DOCUMENTS

| | | | |
|---|---|---|---|
| KR | 10-0810978 | B1 | 3/2008 |
| KR | 10-2010-0128410 | A | 12/2010 |
| KR | 20-2011-0000918 | U | 1/2011 |
| KR | 10-2012-0029653 | A | 3/2012 |

* cited by examiner

CONVERTIBLE HAT

CROSS-REFERENCE TO PRIOR APPLICATIONS

This application is a national Stage Patent Application of PCT International Patent Application No. PCT/KR2020/015369, filed on Nov. 5, 2020 under 35 U.S.C. § 371, which claims priority of Korean Patent Application No. 10-2019-0145972, filed on Nov. 14, 2019, which are all hereby incorporated by reference in their entirety.

TECHNICAL FIELD

The present invention relates to a hat, and more specifically, to a convertible hat that is capable of being used by transforming into other forms.

BACKGROUND ART

A hat, which is established as one of major fashion items, serves to protect a wearer's face from sunlight, fine particles, wind, and the like, while he or she is outdoors or works.

Generally, the hat includes a crown for covering a wearer's head, a band for supporting an outer periphery of the head, and a brim connected to the band and protruding outward by a given area, and according to the shape and size of the brim or the shape or existence of the crown, there are many types of hats such as caps, sun caps, sun visors, bonnets, and the like.

As the brim of the hat is increased in size, sunlight blocking performance is improved, but a wearer's activities or his or her field of vision is restricted. Contrarily, as the brim of the hat is decreased in size, his or her activities or his or her field of vision is ensured, but he or she is exposed extremely to ultraviolet rays or fine particles so that the functionality of the hat may become deteriorated.

So as to provide both of the functionality and conveniences of the hat according to the size of the brim, accordingly, various hats have been developed, but in most cases, the brim is varied in shape or extends in length.

One of conventional hats is disclosed in Korean Patent No. 10-0810978 entitled 'Hat and blocking member for hat', and according to the conventional hat, an auxiliary blocking part used as a blocking member moves along the band to improve sunlight blocking effects. Accordingly, the auxiliary blocking part is attached to a general baseball cap as well as a sun cap, thereby enhancing the sunlight blocking effects.

According to the conventional hat, however, the blocking member is coupled vertically to the brim so that a sunlight blocking area is just enlarged.

Another conventional hat is disclosed in Korean Patent Application Laid-open No. 10-2012-0029653 entitled 'Hat used as sun cap'. According to the conventional hat, side and rear crowns of the hat are connected to a band by means of buttons, and if the buttons are released, the side and rear crowns are located on the underside of a front crown, so that the hat's crown is open to transform the hat into a sun cap. Accordingly, the crown for covering a wearer's head is open to provide good air ventilation and aesthetic effect, which enables the wearer to utilize the hat for various purposes.

According to the conventional hat, however, there is a limitation in that he or she cannot freely adjust a sunlight blocking area according to the intensities of sunlight or outdoor temperatures.

DISCLOSURE

Technical Subject

Accordingly, the present invention has been made to solve the above-mentioned problems, and it is an object of the present invention to provide a convertible hat that is capable of transforming into a general cap for covering a wearer's head, while not obstructing his or her field of vision or into a sun cap for ensuring a sufficient sunlight blocking area in accordance with outdoor temperatures or sunlight intensities.

Technical Solution

To accomplish the above-mentioned objects, according to the present invention, there is provided a convertible hat including: a band covered on the head of a wearer; and a brim coupled horizontally to the front surface of the band to a certain area to thus block sunlight.

Furthermore, the convertible hat of the present invention preferably includes a pair of shape transformation crowns each having one end coupled to the band and the other end located at either a cap position so that the other end spreads out over the band to cover the head of the wearer or a sun cap position so that the other end extends from the sides of the brim to increase a sunlight blocking area of the brim.

Accordingly, the single convertible hat can be used by transforming into the two forms of a cap and a sun cap.

Advantageous Effects

According to the present invention, the convertible hat can transform into the cap or the sun cap in accordance with the wearer's preference and need when he or she is outdoors, exercises, or works.

In addition, the convertible hat according to the present invention can transform into the general cap or the sun cap in accordance with the coupled position of the shape transformation crowns.

Further, the convertible hat according to the present invention can cover the wearer's head to prevent sunlight from being applied to his or her head, while not obstructing his or her field of vision, when it is used as the cap, and extend the sunlight blocking area to protect his or her face from strong sunlight more reliably, while improving air ventilation for his or her head.

Also, the convertible hat according to the present invention can be worn to the form of the cap for providing excellent air ventilation, for example, while the wearer is climbing a mountain, and can be worn to the form of the sun cap for protecting his or her face from sunlight, for example, while he or she is taking a rest on top of the mountain.

Additionally, the convertible hat according to the present invention extends the sunlight blocking area, for example, while the wearer is fishing, so that it can be used as the sun cap, and when he or she is reading a book in a camping spot or wants to avoid people's gaze, further, the convertible hat extends the sunlight blocking area so that it can be used as the sun cap.

EXPLANATIONS OF REFERENCE NUMERALS IN THE DRAWING

Figure 1:
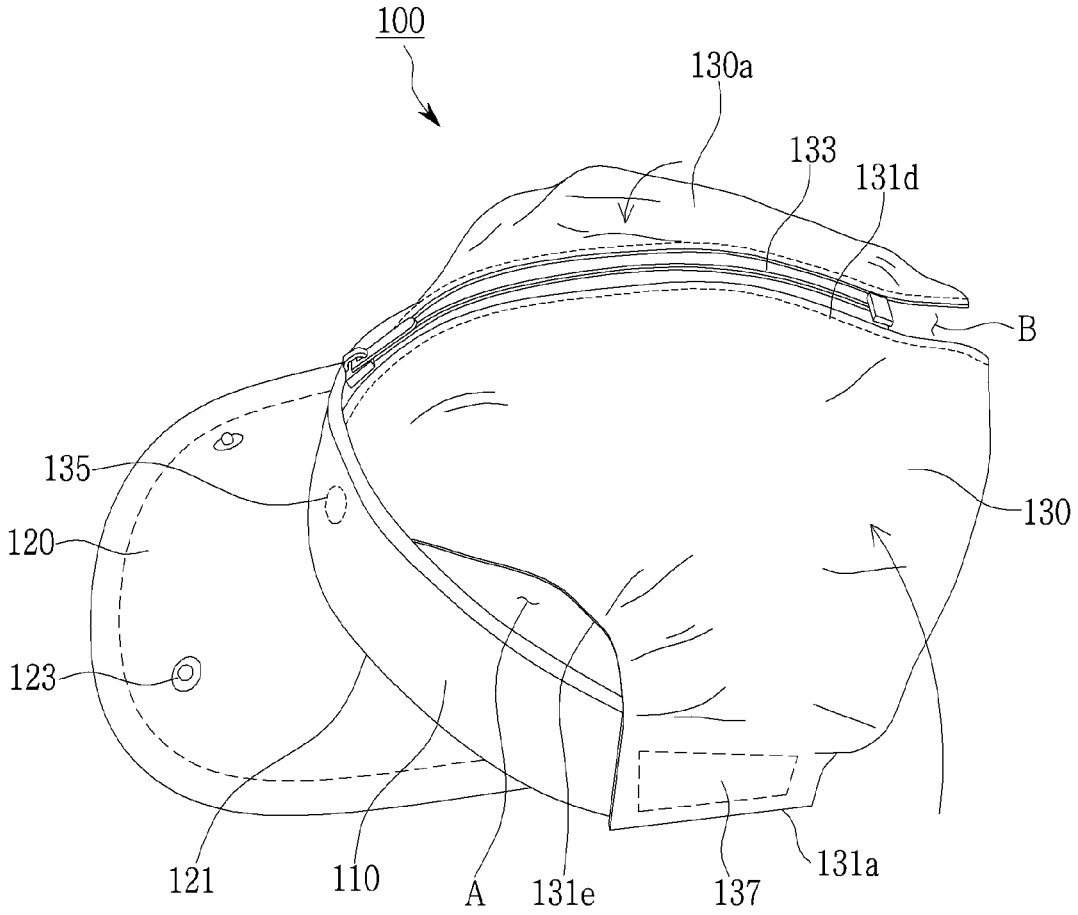
FIG. 1 is a perspective view showing a convertible hat used as a cap according to the present invention.

100: Convertible hat 110: Band
111: Band body 113: First size adjusting member
113*a*: Second size adjusting member 113*b*: Position adjusting hole
113*c*: Position adjusting protrusion 115: Side crown coupling area
117: First detachable coupling member 120: Brim
121: Band coupling line 123: Second detachable coupling member
130: Shape transformation crown 131: Crown body
131*a*: Band side coupling line 131*b*: Rear line
131*c*: Front curved line 131*d*: Coupling position varying line
131*e*: Neck line 133: Crown coupling member
135: Brim position fixing member 136: Folding line
137: Band sewing surface 138: Sewing space
139: Shape maintaining member
A: Front isolation space
B: Rear space

BEST MODE FOR INVENTION

Hereinafter, the present invention will now be described in detail with reference to the attached drawings wherein the corresponding parts in the embodiments of the present invention are indicated by corresponding reference numerals.

In the description, when it is said that one portion is described as "includes" any component, one element further may include other components unless no specific description is suggested.

Figure 2:
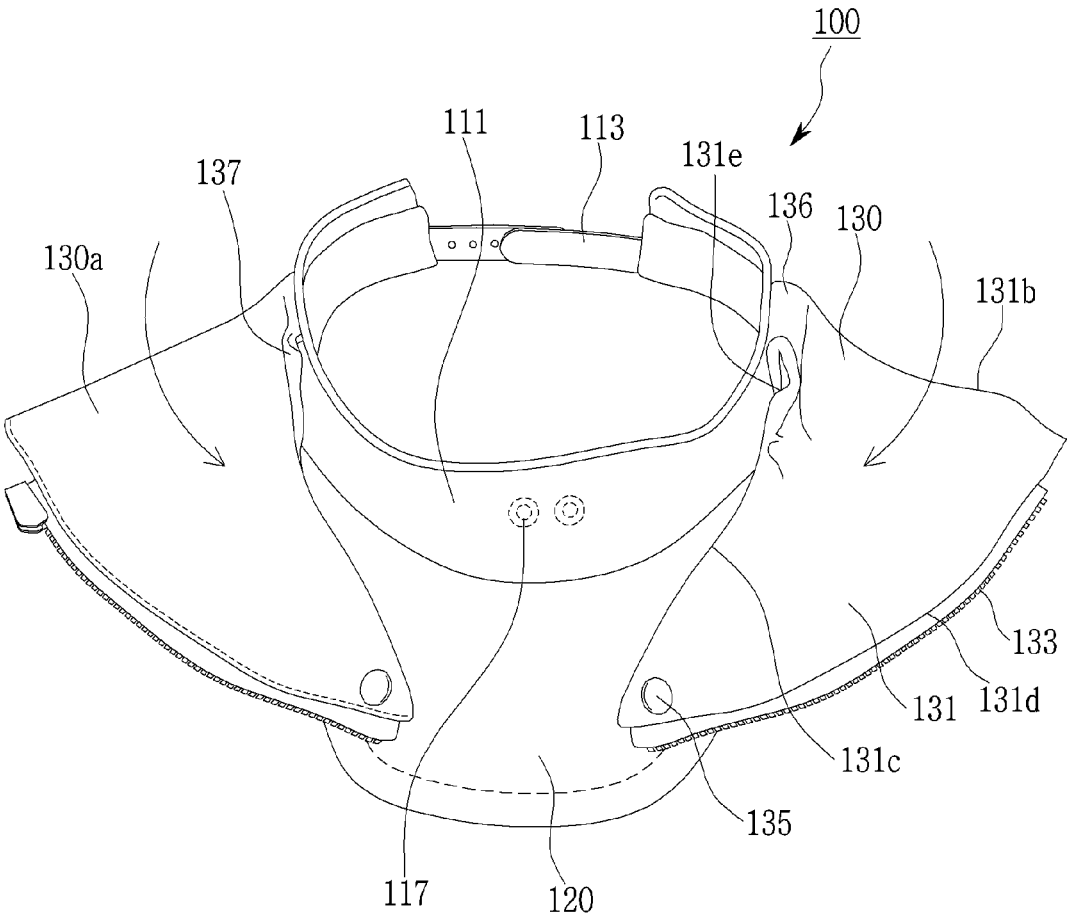
FIG. 2 is a perspective view showing the convertible hat used as a sun cap according to the present invention.

FIG. 1 is a perspective view showing a convertible hat 100 used as a cap according to the present invention, and FIG. 2 is a perspective view showing the convertible hat 100 used as a sun cap according to the present invention.

In this case, a cap represents a general cap for covering a wearer's head, and a sun cap represents a hat with a large sun blocking area, while not covering the wearer's head.

The convertible hat 100 according to the present invention includes a band 110 coupled to a wearer's head, a brim 120 coupled to the front surface of the band 110 to block sunlight, and a pair of shape transformation crowns 130 and 130*a* varied in coupled position to the band 110 and the brim 110 so that the convertible hat 100 can transform into a cap and a sun cap.

The single convertible hat 100 according to the present invention can be used by transforming into the two forms of the cap as shown in FIG. 1 and the sun cap as shown in FIG. 2.

If the convertible hat 100 according to the present invention is used as the cap as shown in FIG. 1, front isolation spaces A and a rear space B from the band 110 are formed by means of the shapes of the shape transformation crowns 130 and 130*a* to thus open the front and rear sides of the convertible hat 100, so that the convertible hat 100 opens the front and rear sides of the wearer's head. Unlike the general cap that completely covers the wearer's head, the convertible hat 100 according to the present invention exposes the front and rear sides of the wearer's head to the outside, thereby advantageously improving air ventilation.

If the convertible hat 100 according to the present invention is used as the sun cap as shown in FIG. 2, further, top of the wearer's head is open and the sun blocking area in front of the wearer's face is increased, thereby effectively blocking sunlight.

Accordingly, the convertible hat 100 according to the present invention can transform into other shapes in accordance with the place, weather, amount of solar radiation, and wind speed when the wearer is active.

Figure 3A:
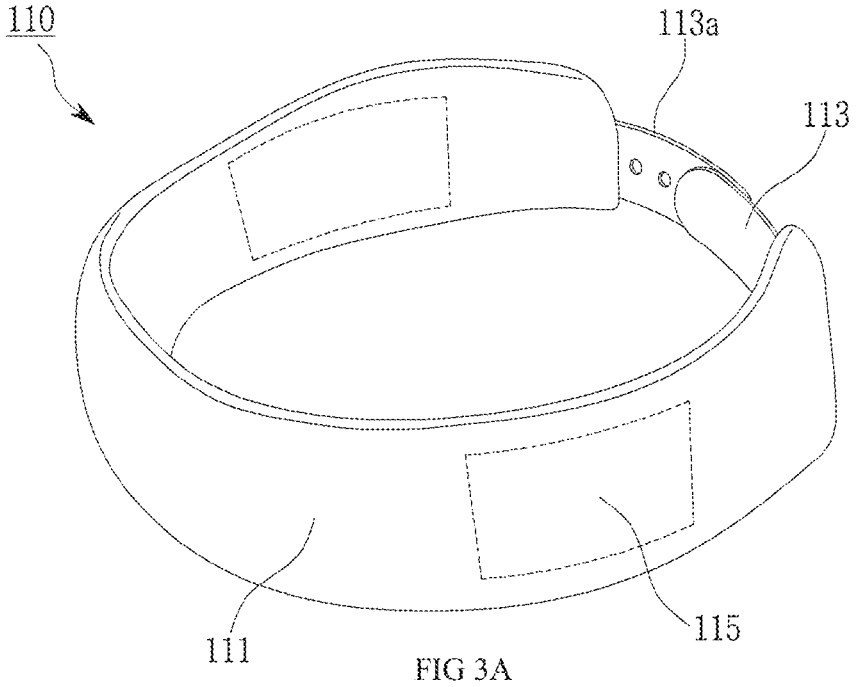
FIGS. 3A and 3B are perspective views showing a band of the convertible hat according to the present invention.
Figure 3B:
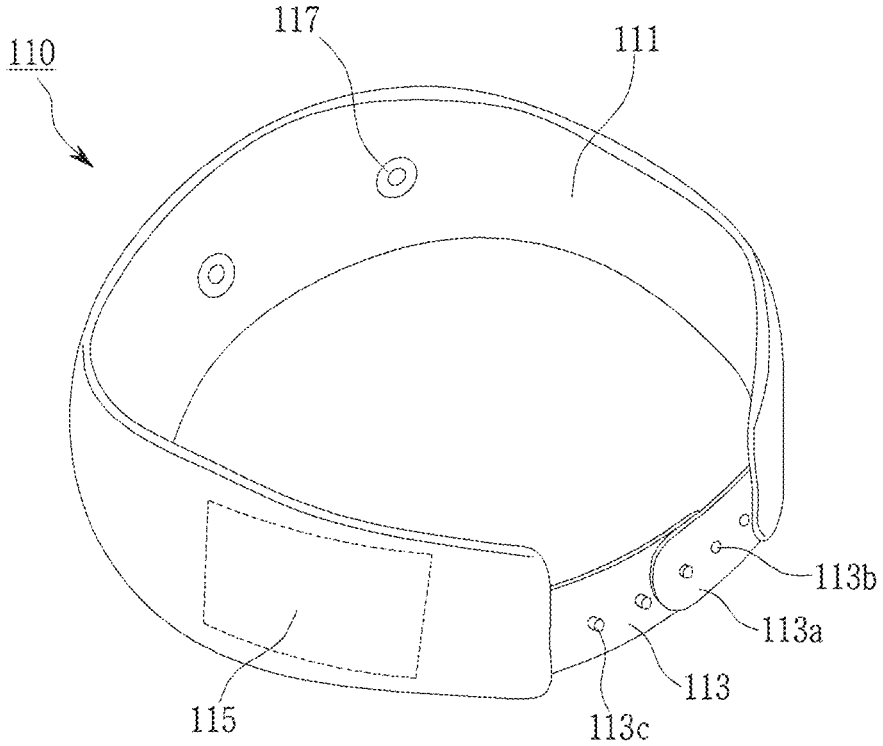

FIGS. 3A and 3B are perspective views showing the band 110 of the convertible hat 100 according to the present invention. The band 110 is fitted to the wearer's head to allow the worn state of the convertible hat 100 to be stably maintained.

As shown in FIGS. 3A and 3B, the band 110 includes a band body 111 with the shape of a band and a pair of size adjusting members 113 and 113*a* disposed on both ends of the band body 111 to adjust the band body 111 in accordance with the wearer's head size.

The band body 111 is made by covering a soft interlining with a fabric. Even though not shown, a fabric with good water absorption ability as a sweatband may be disposed on the inside of the band body 111 to improve the contact performance with the wearer's forehead and the sweat absorption ability.

One side size adjusting member 113 has a plurality of position adjusting holes 113*b*, and the other member 113*a* has a plurality of position adjusting protrusions 113*c*. Accordingly, the position adjusting protrusions 113*c* are appropriately fitted to the position adjusting holes 113*b* in accordance with the wearer's head size.

The convertible hat 100 according to the present invention is configured to allow the band 110 to have the size adjusting members 113 and 113*a*, but in some cases, the convertible hat 100 may not have any size adjusting members. In the case where no size adjusting members are provided, the size of the band 110 may be adjusted by means of a rubber band or belt.

Further, the band 110 includes side crown coupling areas 115 formed on both sides of the band body 111. The side crown coupling areas 115 are coupled to band side coupling lines 131*a* of the shape transformation crowns 130 and 130*a*. In this case, the side crown coupling areas 115 are coupledly sewn onto band sewing surfaces 137.

Further, the band 110 includes first detachable coupling members 117 disposed on the inner area with which the wearer's head comes into contact. If the convertible hat 100 is used as the cap as shown in FIG. 1, the first detachable coupling members 117 are coupled to brim position fixing members 135 of the shape transformation crowns 130 and 130*a*.

The first detachable coupling members 117 have the corresponding shapes to the brim position fixing members 135. As shown, if the brim position fixing members 135 are male buttons, the first detachable coupling members 117 are female button. In some cases, further, they may be female and male Velcro tapes.

The first detachable coupling members 117 are disposed on the inner surface of the band body 111 so that they are not exposed to the outside.

The brim 120 has a given area extending horizontally from the front surface of the band 110 to block the sunlight from the wearer's face. The brim 120 is made by covering a plastic material having the corresponding shape thereto with a fabric.

As shown in FIG. 1, the brim 120 is fixedly coupled to the band 110. To do this, the brim 120 has a band coupling line 121 sewn onto the bottom of the band 110 so that it can be firmly fixed to the band 110.

The brim 120 has a pair of second detachable coupling members 123 on both sides of top thereof. If the convertible hat 100 is used as the sun cap as shown in FIG. 2, the second detachable coupling members 123 are detachably coupled to the brim position fixing members 135 of the shape transformation crowns 130 and 130*a*.

In the same manner as the first detachable coupling members 117, the second detachable coupling members 123 have the corresponding shapes to the brim position fixing members 135.

Figure 4:
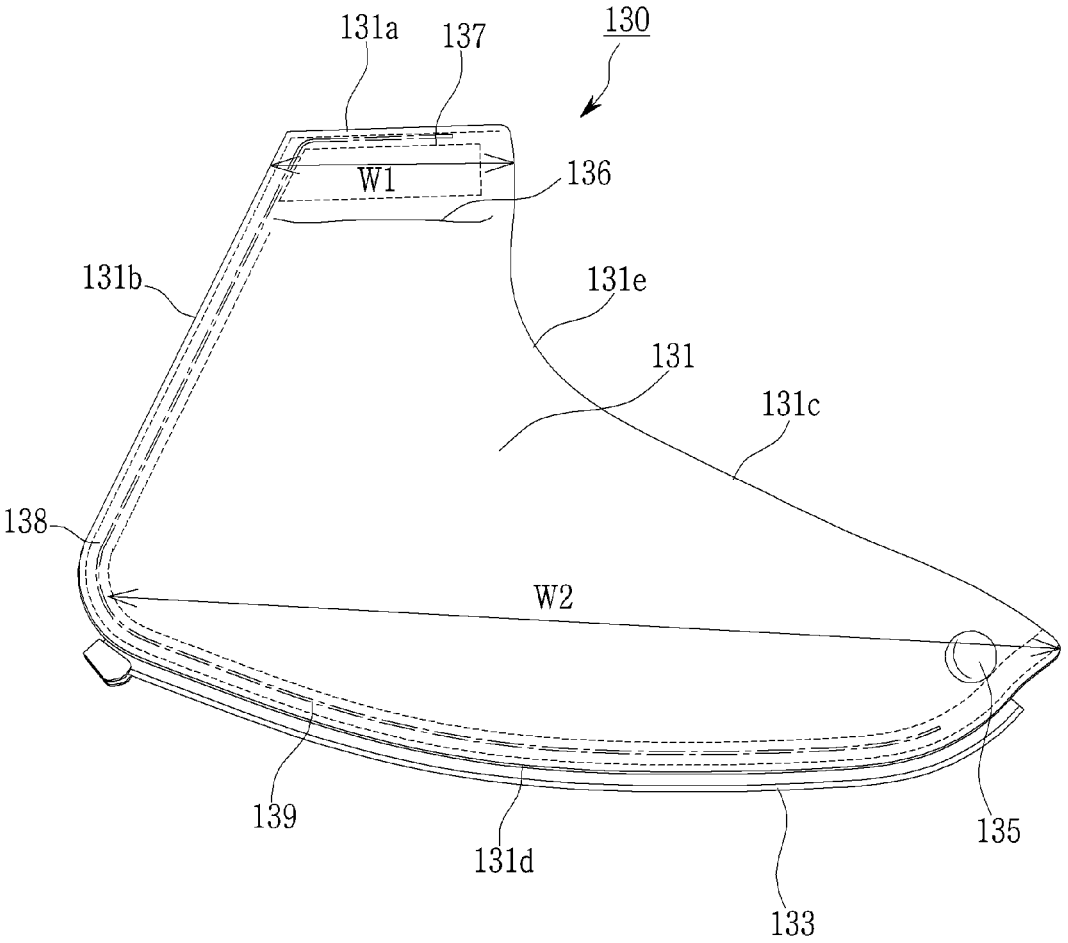
FIG. 4 is a front view showing a pair of shape transformation crowns of the convertible hat according to the present invention.

FIG. 4 is a front view showing the pair of shape transformation crowns 130 and 130*a* of the convertible hat 100 according to the present invention. The pair of shape transformation crowns 130 and 130*a* serves to allow the convertible hat 100 to transform into the cap or the sun cap as it is varied in a coupled position to the band 110 or the brim 120.

Each of the shape transformation crowns 130 and 130*a* has a ㄴ-shaped crown body 131, a crown coupling member 133 disposed on the bottom of the crown body 131, and the brim position fixing member 135 disposed on the front end of the crown body 131.

The crown body 131 is formed surroundingly by means of the band side coupling line 131*a* coupled to the side crown coupling area 115 of the band 110, a coupling position varying line 131*d* disposed on the other end of the band side coupling line 131*a*, a front curved line 131*c* for curvedly connecting the band side coupling line 131*a* and the coupling position varying line 131*d* on the front side thereof, and a rear line 131*b* for connecting the band side coupling line 131*a* and the coupling position varying line 131*d* in a straight line shape on the rear side thereof.

The crown body 131 may be made of a fabric, a soft plastic, a soft metal, leather, rubber, or paper.

In this case, a width W1 of the band side coupling line 131*a* corresponds to the width of the side crown coupling area 115 of the band 110, and if the convertible hat 100 is used as the cap as shown in FIG. 1, a width W2 of the coupling position varying line 131*d* has a given length capable of covering the wearer's head.

The front curved line 131*c* has the shape of a gentle curved line, and further, a neck line 131*e* is concavely formed on the front curved line 131*c*. The curved shape of the front curved line 131*c* enables the spherical shape of the head to be covered in a solid shape thereof when the crown body 131 is bent on top of the wearer's head so as to use the convertible hat 100 as the cap, and further, the curved shape of the front curved line 131*c* enables the crown body 131 to be easily coupled to the brim 120 if it is desired that the crown body 131 is separated from the wearer's head, coupled to the brim 120, and transforms into a horizontally planar shape so as to use the convertible hat 100 as the sun cap.

As shown in FIG. 1, the shapes of the front curved line 131*c* and the neck line 131*e* are desirably determined in consideration of the curvature of an adult head and the sides of the band 110 and the brim 120.

If the crown bodies 131 unfoldedly spread out over the band 110 so as to use the convertible hat 100 as the cap as shown in FIG. 1, the front curved lines 131*c* and the neck lines 131*e* serve to form the solid curves between the crown bodies 131 and the band 110 so that when the convertible hat 100 is worn on the wearer's head, it makes him or her feel comfortable. Further, the front isolation spaces A are formed between the band 110 and the crown bodies 131 by means of the concave depths of the neck lines 131*e*, and they serve to improve the air ventilation as well as to allow the wearer's head to be freely inserted into the crown bodies 131.

If the crown bodies 131 are unfolded horizontally from both sides of the band 110 so as to use the convertible hat 100 as the sun cap as shown in FIG. 2, the front curved lines 131*c* and the neck lines 131*e* form given curvatures so that they can be located, without getting loose from the planar surface of the brim 120.

The neck line 131*e* has a given curvature and a given concave depth so that when it is folded by means of a folding line 136, folds and wrinkles with the front curved line 131*c* can be minimized.

The rear line 131*b* connects the band side coupling line 131*a* and the coupling position varying line 131*d* in the straight line shape. If the crown bodies 131 are coupled to the cap coupling positions as shown in FIG. 1, the rear space B of the rear line 131*b* is open to allow air to be ventilated behind the wearer's head.

If the crown bodies 131 are coupled to the sun cap coupling positions as shown in FIG. 2, the rear lines 131*b* produce maximum widths capable of blocking sunlight on sides of the convertible hat 100. The rear lines 131*b* are unfolded horizontally from the rear sides of the wearer's ears to sufficiently block the wearer's entire face from sunlight.

The crown coupling members 133 are disposed on the edges of the coupling position varying lines 131*d*, respectively, and if the crown bodies 131 are coupled to the cap coupling positions as shown in FIG. 1, they serve to couple the pair of shape transformation crowns 130 and 130*a* to each other. Accordingly, the pair of shape transformation crowns 130 and 130*a* is coupled to each other by means of the crown coupling members 133 to thus cover the wearer's head.

Figure 7:
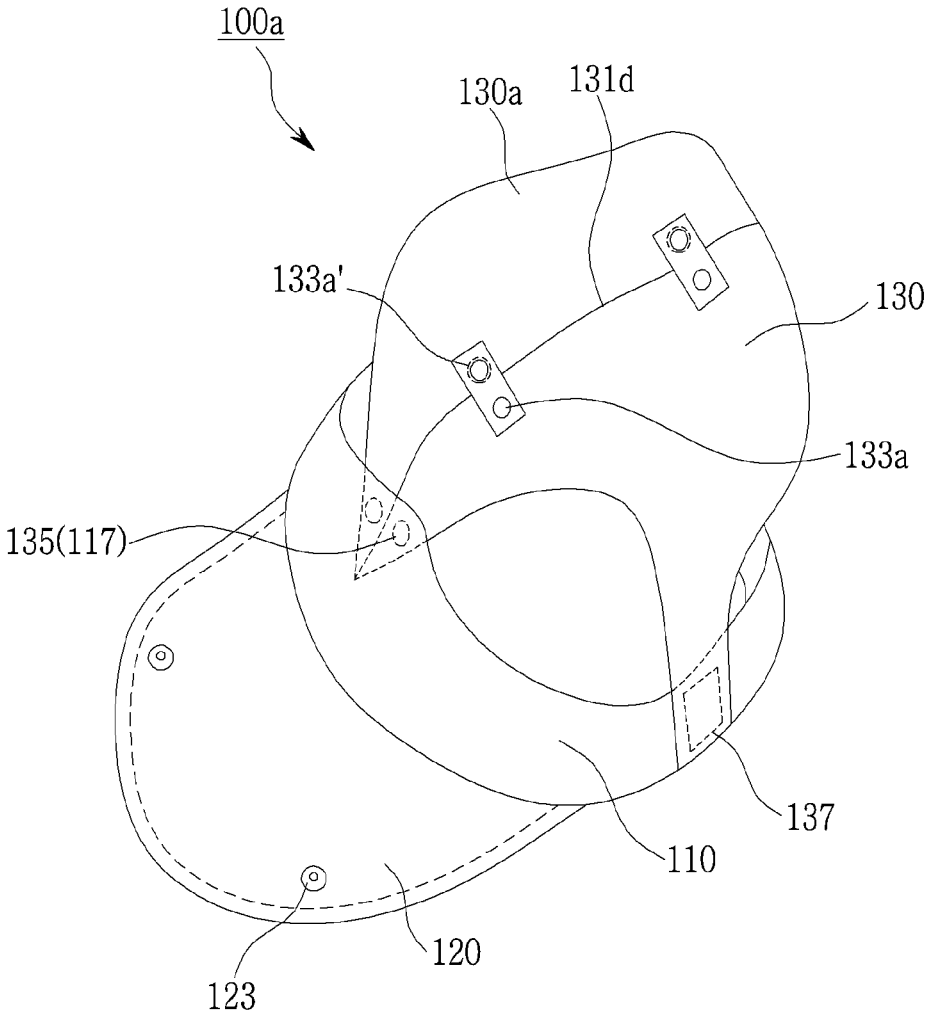
FIGS. 7 to 10 are exemplary views showing various modifications of the convertible hat according to the present invention.
Figure 8:
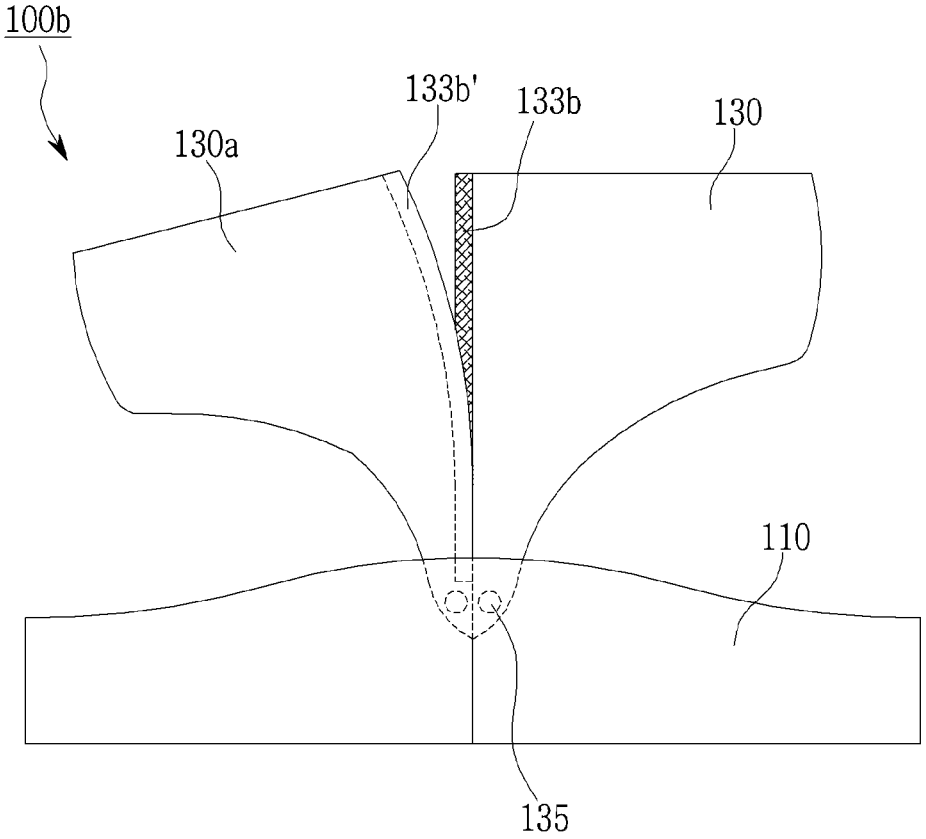

As shown, the crown coupling members 133 have the shape of a zipper. However, of course, they may be provided in the form of snap buttons 133*a* and 133*a*' as shown in FIG. 7, and otherwise, they may be provided in the form of female and male Velcro members 133*b* and 133*b*' as shown in FIG. 8.

In this case, the female and male Velcro members 133*b* and 133*b*' extend up to the inner side of the band 110 so that they can be prevented from being unfastened due to external impacts or even during the activity of the wearer.

If the female and male Velcro members 133*b* and 133*b*' are separated from each other so as to allow the convertible hat 100 to be used as the sun cap, further, they are coupled to separately provided female and male Velcro members 133*b* and 133*b*' corresponding thereto. If such coupling does not exist, the female and male Velcro members 133*b* and 133*b*' are exposed to the outside to cause the wearer's hand to hurt when he or she touches the pair of shape transformation crowns 130 and 130*a*.

As shown in FIG. 4, each brim position fixing member 135 of the shape transformation crowns 130 and 130*a* is disposed on the edge where the front curved line 131*c* and the coupling position varying line 131*d* meet each other. When the convertible hat 100 is used as the cap, the brim position fixing members 135 are coupled to the first detachable coupling members 117 of the band 110, and when the convertible hat 100 is used as the sun cap, the brim position fixing members 135 are coupled to the second detachable coupling members 123 of the brim 120.

The brim position fixing members 135 have the shapes of female and male buttons, but in some cases, they may be provided in the forms of various detachable fastening members such as female and male Velcro tapes, snap buttons, magnets, and the like.

The band sewing surfaces 137 are formed on top of the band side coupling lines 131*a* and sewn onto the side crown coupling areas 115 coming into contact with the band 110. The band sewing surfaces 137 serve to fixedly couple the band side coupling lines 131*a* of the crown bodies 131 to the sides of the band 110.

In the state where the lower portions of the shape transformation crowns 130 and 130*a* are fixed to the band 110, accordingly, only the coupling position varying lines 131*d* are varied in position to allow the convertible hat 100 to be used as the cap and the sun cap.

Figure 9:
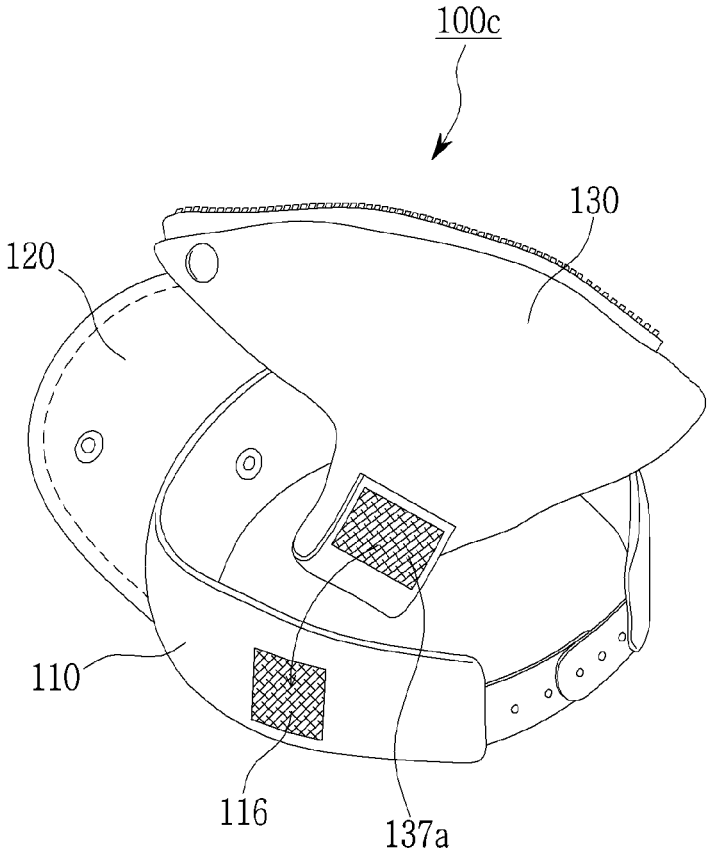
Figure 10:
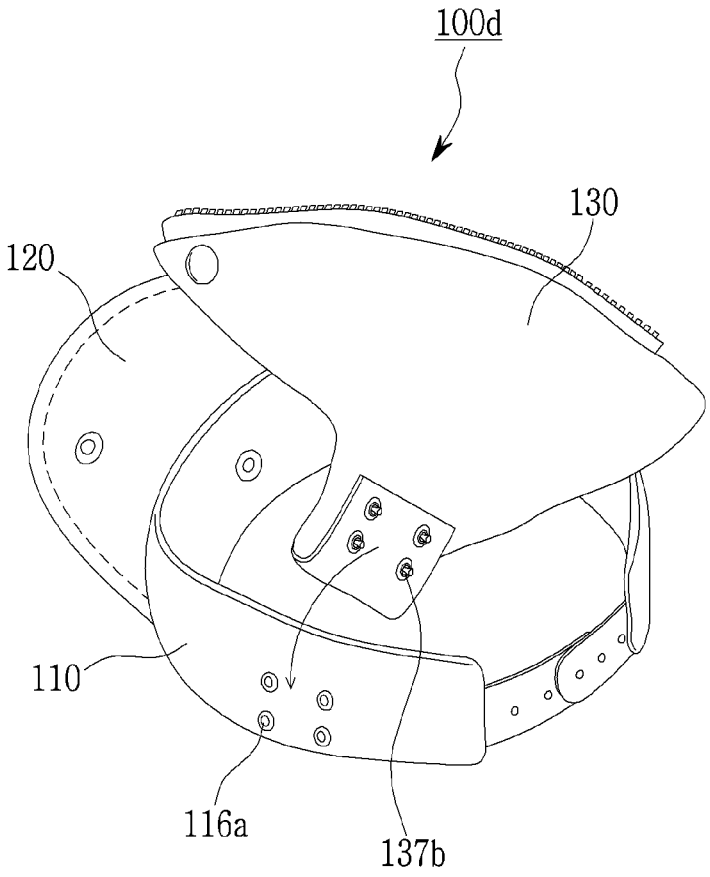

However, the above-mentioned embodiment of the present invention is just exemplary, and further, as shown in FIG. 9, the band side coupling lines 131*a* are detachably coupled to the band 110 by means of female and male Velcro members 137*a* and 116. Otherwise, as shown in FIG. 10, the band side coupling lines 131*a* are detachably coupled to the band 110 by means of snap buttons 137*b* and 116*a*.

Like this, if the band side coupling lines 131*a* are detachably coupled to the band 110, the pair of shape transformation crowns 130 and 130*a* may be separated from the band 110 to allow the convertible hat 100 to be used as a simple cap only with the brim 120 and the band 110.

Moreover, the folding lines 136 are formed above the band sewing surfaces 137. If the convertible hat 100 is used as the sun cap as shown in FIG. 2, the folding lines 136 serve to support the crown bodies 131 so that the crown bodies 131 are folded outward. Wires are inserted into the folding lines 136 and folded toward the neck lines 131*e* to allow the neck lines 131*e* to come into contact with the band 110 and to permit the crown bodies 131 to be maintained to the planar shape, without getting loose or having any wrinkles thereon.

Further, shape maintaining members 139 are insertedly fitted to the rear lines 131*b* and the coupling position varying lines 131*d* of the crown bodies 131, respectively. The shape maintaining members 139 serve to allow the shape transformation crowns 130 and 130*a* disposed on both sides of the brim 120 to be maintained horizontally, without sagging downward.

The shape maintaining members 139 are adjusted in shape in consideration of the angle of incidence of sunlight to freely control the sunlight blocking angles of the shape transformation crowns 130 and 130*a*.

Figure 5:
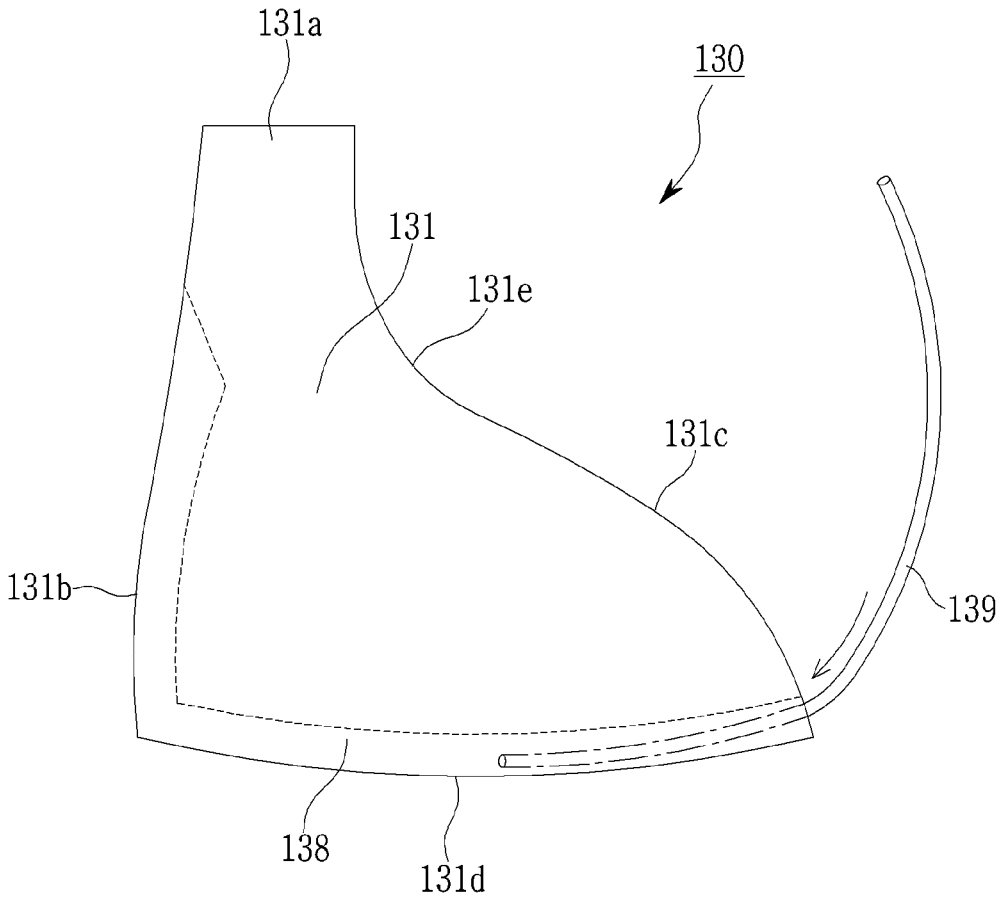
FIG. 5 is an exemplary view showing a process of inserting shape-maintaining members into the shape transformation crowns of the convertible hat according to the present invention.

The shape maintaining members 139 are made of wire members whose shape is varied by means of an external force, such as, a steel wire. FIG. 5 is an exemplary view showing a process of inserting the shape maintaining member 139 into the crown body 131. As shown, a sewing space 138 is formed along the edges of the rear line 131*b* and the coupling position varying line 131*d* of the crown body 131, and the shape maintaining member 139 is inserted into the sewing space 138 and thus fixed to the crown body 131.

Under the above-mentioned configuration, a process of using the convertible hat 100 according to the present invention will be explained with reference to FIGS. 1 to 10.

The includes

Figure 6:
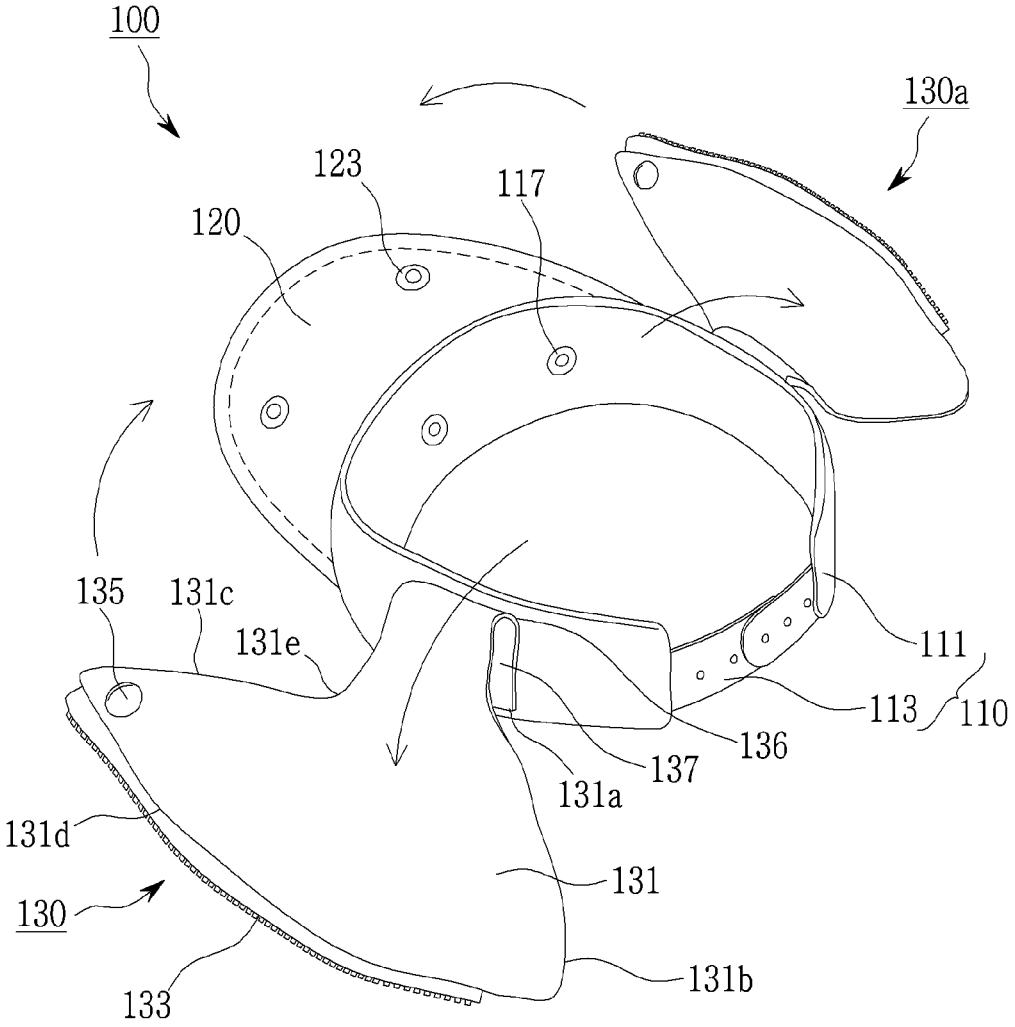
FIG. 6 is an exemplary view showing a process of transforming the convertible hat as the cap according to the present invention into a sun cap.

If the wearer wants to wear the convertible hat 100 in a place where sunlight is not strong, he or she transforms the convertible hat 100 into the cap as shown in FIG. 1. To do this, the pair of shape transformation crowns 130 and 130*a* unfolded from both sides of the convertible hat 100, as shown in FIG. 6, is lifted over the band 110, as shown in FIG. 1, and the crown coupling members 133 having the shape of the zipper are fastened to each other.

Next, the brim position fixing members 135 located on the front ends of the shape transformation crowns 130 and 130*a* are coupled to the first detachable coupling members 117 located on the inside of the band 110.

Like this, if the convertible hat 100 transforms into the cap, air moves through the front isolation spaces A between the band 110 and the neck lines 131*e*, and further, air moves through the rear space B between the rear lines 131*b* and the band 110.

That is, the wearer's head is covered with the pair of shape transformation crowns 130 and 130*a* of the cap and is not exposed to the outside, thereby being protected from sunlight, wind, dust, and the like. Further, air ventilation is performed well through the front isolation spaces A and the rear space B, thereby making the wearer feel cool.

Contrarily, if it is desired to transform the convertible hat 100 as the cap into the sun cap, the brim position fixing members 135 are separated from the first detachable coupling members 117, and next, the crown coupling members 133 are separated from each other.

As shown in FIG. 6, the pair of crown coupling members 135 separated from each other is folded horizontally around the folding lines 136 toward both sides of the convertible hat 100. In this case, the crown bodies 131 pull toward the brim 120 to allow the neck lines 131*e* to come into contact with the band 110, and next, the crown coupling members 133 are fixed to the second detachable coupling members 123.

Accordingly, as shown in FIG. 2, the convertible hat 100 transforms into the sun cap. In this case, the convertible hat 100 as the sun cap is worn on the wearer's head, and if the shape maintaining members 139 are pressurized by the wearer's hands, the sunlight blocking angles and shapes can be arbitrarily adjusted.

As set forth in the foregoing, the convertible hat according to the present invention can transform into the cap or the sun cap in accordance with the wearer's preference and need when he or she is outdoors, exercises, or works.

The convertible hat according to the present invention can be used as the cap or sun cap, depending on the location where the shape transformation crown is coupled.

As described above, the technical scope of the present invention has been described with reference to the particular illustrative embodiments.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. A convertible hat comprising:

a band (110) configured to extend around a wearer's head;

a brim (120) coupled to the band (110) to block sunlight; and a first shape transformation crown and a second shape transformation crown (130, 130*a*), said first shape transformation crown (130) having a first end defined by a first lower edge and a second end defined by a first upper edge, said second shape transformation crown (130*a*) having a first end defined by a second lower edge and a second end defined by a second upper edge, wherein said first end of the first shape transformation crown (130) is coupled to a side of the band (110), said first end of the second shape transformation crown (130*a*) is coupled to an opposite side of the band (110), and said second ends of the first and second shape transformation crown (130, 130*a*) are configured to be detachably coupled together in a cap position or to be folded outwardly over the band (110) to extend from sides of the brim (120) in a sun cap position so that the second ends of the first and second shape transformation crown (130, 130*a*) extends from sides of the brim (120) to increase a sunlight blocking area of the brim (120), wherein each of the shape transformation crowns (130 and 130*a*) comprises:

a crown body (131) with a band side coupling line (131*a*) at the first and second lower edge, a coupling position varying line (131*d*) at the first and second upper edge, and a straight rear edge extending between the band side coupling line (131*a*) and the coupling position varying line (131*d*), wherein each crown body (131) is configured to be folded outwardly such that a front curved line is formed as the coupling position varying line (131*d*) contacts the band side coupling line (131*a*);

a crown coupling member (133) disposed at the first and second upper edges to connect the coupling position varying line (131*d*) of the first shape transformation crown to the coupling position varying line (131*d*) of the second shape transformation crown in the cap position; and a brim position fixing member (135) disposed at a front portion of each crown body (131) for securing the crown body (131) to a respective second detachable coupling member (123) on opposed sides of a top of the brim (120) in the sun cap position, and a first detachable coupling member (117) disposed at an inside front portion of the band (110) for securing to the brim position fixing member (135) in the cap position.

2. The convertible hat according to claim 1, further comprising an inner area of the band (110) configured to contact the wearer's head.

3. The convertible hat according to claim 1, further comprising said band (110) having opposed lateral sides and said band side coupling line (131*a*) configured to be coupled to both sides of the band (110), shape-maintaining members (139) positioned along the rear edges (131*b*) of the crown bodies (131) and the coupling position varying lines (131*d*) to allow the pair of shape transformation crowns (130 and 130*a*) at the sun cap position to be maintained in shape horizontally, without sagging downward.

4. The convertible hat according to claim 3, wherein the crown coupling members (133) are selected from the group consisting of a zipper, hook and loop members, buttons, and magnets.

* * * * *